US007574829B1

(12) United States Patent
Prager

(10) Patent No.: US 7,574,829 B1
(45) Date of Patent: Aug. 18, 2009

(54) APPARATUS FOR DRAINING RAIN WATER FROM WINDOW TRACKS DURING HIGH WINDS

(76) Inventor: Melvin Prager, 1151 N. Fort Lauderdale Beach Blvd., Unit 12-C, Fort Lauderdale, FL (US) 33304

( * ) Notice: Subject to any disclaimer, the term of this patent is extended or adjusted under 35 U.S.C. 154(b) by 196 days.

(21) Appl. No.: 11/701,991

(22) Filed: Feb. 5, 2007

(51) Int. Cl.
*E06B 7/14* (2006.01)

(52) U.S. Cl. ..... 49/408; 52/209; 52/302.1

(58) Field of Classification Search ..... 49/408; 52/205.52, 209, 302.1, 302.3, 302.7
See application file for complete search history.

(56) References Cited

U.S. PATENT DOCUMENTS

| | | | | | |
|---|---|---|---|---|---|
| 364,434 | A | * | 6/1887 | Pitmon | 49/471 |
| 1,320,864 | A | * | 11/1919 | James | 454/196 |
| 1,945,816 | A | * | 2/1934 | Leigh | 52/209 |
| 2,096,892 | A | * | 10/1937 | Frederick | 52/171.3 |
| 3,106,754 | A | * | 10/1963 | Abraham | 49/408 |
| 3,314,201 | A | * | 4/1967 | Riegelman | 52/209 |
| 3,410,027 | A | * | 11/1968 | Bates | 49/471 |
| 3,466,819 | A | * | 9/1969 | Giger | 52/1 |
| 3,845,599 | A | * | 11/1974 | Jolly | 52/209 |
| 3,919,815 | A | * | 11/1975 | Alabaster | 52/97 |
| 4,553,361 | A | * | 11/1985 | Ralph | 52/209 |
| 4,691,487 | A | * | 9/1987 | Kessler | 52/209 |
| 5,123,212 | A | * | 6/1992 | Dallaire et al. | 52/209 |
| 5,596,151 | A | * | 1/1997 | Rossini | 73/861.55 |
| 5,956,909 | A | * | 9/1999 | Chou | 52/209 |
| 6,848,225 | B2 | * | 2/2005 | Lapierre | 52/204.53 |
| 6,883,279 | B2 | * | 4/2005 | Fukuro et al. | 52/209 |

FOREIGN PATENT DOCUMENTS

| | | | | |
|---|---|---|---|---|
| EP | 294361 | A2 | * | 12/1988 |
| GB | 2092213 | A | * | 8/1982 |
| GB | 2104579 | A | * | 3/1983 |
| GB | 2144791 | A | * | 3/1985 |
| GB | 2180871 | A | * | 4/1987 |
| GB | 2209787 | A | * | 5/1989 |
| GB | 2229479 | A | * | 9/1990 |
| GB | 2230042 | A | * | 10/1990 |

* cited by examiner

*Primary Examiner*—Jerry Redman
(74) *Attorney, Agent, or Firm*—Oltman, Flynn & Kubler

(57) ABSTRACT

A rain draining apparatus for a sliding window assembly of a building mounted within a window opening and having a track and windows slidably retained within the track includes a drain conduit having a linking segment extending from and in fluid communication with a window track inside a building, and having an upright segment extending from and in fluid communication with the linking segment and extending below the window track and opening outside the building, the upright segment being in fluid communication with a check valve; and a pressure equalizing vent structure for equalizing air pressure throughout the drain conduit extending from and opening within the building into the drain conduit upright segment; so that water in the track flows into the upright segment and accumulates as a column above the check valve and then drains through the check valve when the column reaches a sufficient weight to overcome the opposing force of outside air pressure.

13 Claims, 3 Drawing Sheets

APPARATUS FOR DRAINING RAIN WATER FROM WINDOW TRACKS DURING HIGH WINDS

FILING HISTORY

This application is based upon the contents of Disclosure Document Number 602909 filed on Jun. 29, 2006.

BACKGROUND OF THE INVENTION

1. Field of the Invention

The present invention relates generally to the field of storm wind protection devices. More specifically the present invention relates to a window track rain draining apparatus for use during high winds, such as from hurricanes, which raise outside air pressure against a window assembly to a level greater than the air pressure within the building. This pressure differential drives water collected in a window track into the building and by the same token prevents the collected water from draining outside the building.

The present draining apparatus provides a drain conduit having a linking segment extending from a point within the track and inside the building to an upright segment containing a check valve and extending below the track and to a point outside the building, and provides a pressure equalizing vent structure which equalizes air pressure throughout the drain conduit, permitting water in the track to drain outside the building. A sliding window assembly of a building typically includes a track configured as a channel having window guides including channel sides in the form of upright longitudinal flanges within the channel and framed windows slidably retained within the window guides. The linking segment preferably takes the form of a drain tube and the drain conduit upright segment preferably takes the form of a standpipe, the drain tube being fitted through at least one tube port formed in a track guide and leading into the standpipe and outside the windows to open. The check valve is provided in the standpipe lower end which permits water entering the standpipe to accumulate as a column above the check valve and then to drain through the check valve when the column reaches a sufficient height and thus a sufficient weight to overcome the opposing force of the outside air pressure. The pressure equalizing vent structure equalizes air pressure in the standpipe above the column of water with the air pressure inside the building, and preferably takes the form of a pressure equalization tube extending from inside the building into the standpipe upper end, and which preferably passes axially through the drain tube into the standpipe.

2. Description of the Prior Art

There have long been window assemblies in window openings of building walls each including a window track within which framed windows are slidably mounted so that a first window can slide parallel to a second window along track guides to a closed position partly overlapping and extending beyond the first window and fully closing the window opening, and can slide in the opposite direction along track guides to an open position laterally adjacent and face to face with the first window to leave an open region within the window opening. Storm winds drive rain water against the closed windows assembly which collects in the window track and is driven under the windows and across the track into the building by a pressure differential between the outside air blowing against the windows and the static air within the building, leading to water damage. The pressure differential develops because wind blowing against the windows can raise air pressure outside the windows to a level significantly greater than that within the building.

Gager, U.S. Pat. No. 3,466,819, issued on Sep. 16, 1969, discloses a drain construction for a window sash and the like. Gager includes a window track having a lateral port fitted with a check valve. A problem with the check valve is that greater air pressure outside the building than within the track would tend to prevent the check valve from opening.

Kessler, U.S. Pat. No. 4,691,487, issued on Sep. 8, 1987, teaches a drain tube for windows. Burton, U.S. Patent Application Publication Number 2005/0097837 published on May 12, 2005, reveals a method and system for managing water infiltration at window openings. Fukuro, et al., U.S. Pat. No. 6,883,279, issued on Apr. 26, 2005, discloses an outdoor window including a window track with drain openings. A problem with Fukuro, et al., is that no provision is made to equalize pressure. Ö Donnell, U.S. Pat. No. 6,374,557, issued on Apr. 23, 2002, teaches a weep hole construction for a window unit. Ting, U.S. Pat. No. 6,393,778, issued on May 28, 2002, discloses an airloop window system using air loops to isolate window system air seals from water seals so that the window system can tolerate imperfect seals and resist water infiltration. Edger, U.S. Pat. No. 6,334,283, issued on Jan. 1, 2002, reveals a water resistant window frame for increasing water resistance by incorporating a chamber including a trough to prevent water back-up and spilling over the interior of the frame. Hope, U.S. Pat. No. 5,890,331, issued on Apr. 6, 1999, discloses a window drainage channel fitted with a drain tube for draining water from a window support frame. Harbom, et al., U.S. Pat. No. 5,044,121, issued on Sep. 3, 1991 teaches a window and door structure having a structure for equalizing air pressure within a window or door sash about the perimeter and front of the sash to prevent water accumulation within the sash.

It is thus an object of the present invention to provide a window track rain draining apparatus which includes a drain tube opening into and extending from the track and an upright standpipe in fluid communication with the drain tube containing a check valve and extending below the track and opening outside the building and a pressure equalizing vent structure which equalizes air pressure within the standpipe to that within the building so that water can accumulate within the standpipe until the weight of the water per unit area is greater than outside air pressure, and the water can drain from the standpipe through the check valve outside the building.

It is another object of the present invention to provide such a window track rain draining apparatus which can be installed easily as an aftermarket assembly or which can be manufactured as a stock part of a window track.

It is still another object of the present invention to provide such a window track rain draining apparatus which is relatively inconspicuous.

It is finally an object of the present invention to provide such a window track rain draining apparatus which is reliable and inexpensive to manufacture.

SUMMARY OF THE INVENTION

The present invention accomplishes the above-stated objectives, as well as others, as may be determined by a fair reading and interpretation of the entire specification.

A rain draining apparatus is provided for a sliding window assembly of a building mounted within a window opening in a building wall having a track configured as a channel with window guides in the form of upright longitudinal flanges and framed windows slidably retained within the guides, the rain draining apparatus including a drain conduit having a linking segment extending from and in fluid communication with a window track inside a building, and having an upright segment extending from and in fluid communication with the linking segment and extending below the window track and opening outside the building, the upright segment being in fluid communication with a check valve; and a pressure equalizing vent structure for equalizing air pressure throughout the drain conduit extending from and opening within the building into the drain conduit upright segment; so that water in the track flows through the linking segment and into the upright segment and accumulates as a column within the upright segment above the check valve and then drains through the check valve when the column reaches a sufficient height and thus a sufficient weight to overcome the opposing force of outside air pressure.

The drain conduit linking segment preferably includes a drain tube and the drain conduit upright segment preferably includes a standpipe, the drain tube being fitted through at least one track port formed in the track and opening into the standpipe extending below the window track along the building wall; and the check valve preferably is contained within the lower end of the standpipe. The standpipe optionally is suspended outside the building along the building wall. The standpipe optionally is contained within the building wall. The standpipe optionally is suspended inside the building along the building wall, the rain draining apparatus additionally including an extension tube connected to and opening into the standpipe and extending outside the building through a passageway in the building wall. The pressure equalizing vent structure preferably includes a pressure equalization tube extending from inside the building and opening into the standpipe. The pressure equalizing tube preferably passes through the drain tube into the standpipe.

A combined sliding window assembly and rain draining apparatus is provided, including a building wall of a building having a window opening; a sliding window assembly mounted within the window opening having a window track configured as a channel and windows slidably retained within the window track; a rain draining apparatus including a drain conduit having a linking segment extending from and in fluid communication with the window track inside the building, and having an upright segment extending from and in fluid communication with the linking segment and extending below the window track and opening outside the building, the upright segment being in fluid communication with a check valve; and a pressure equalizing vent structure for equalizing air pressure throughout the drain conduit extending from and opening within the building into the drain conduit upright segment; so that water in the track flows through the linking segment and into the upright segment and accumulates as a column within the upright segment above the check valve and then drains through the check valve when the column reaches a sufficient height and thus a sufficient weight to overcome the opposing force of outside air pressure. The pressure equalizing tube preferably passes through the drain tube into the standpipe.

A combined sliding window assembly and rain draining apparatus is still further provided, including a building wall of a building having a window opening; a sliding window assembly mounted within the window opening having a window track configured as a channel and windows slidably retained within the window track; a rain draining apparatus including a drain conduit having an upright segment extending from and in fluid communication with the window track inside the building and extending below the window track and opening outside the building, the upright segment being in fluid communication with a check valve, and an extension tube connected to and opening into the standpipe and extending outside the building through a passageway in the building wall; and a pressure equalizing vent structure for equalizing air pressure throughout the drain conduit extending from and opening within the building into the drain conduit upright segment; so that water in the track flows into the upright segment and accumulates as a column within the upright segment above the check valve and then drains through the check valve when the column reaches a sufficient height and thus a sufficient weight to overcome the opposing force of outside air pressure.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
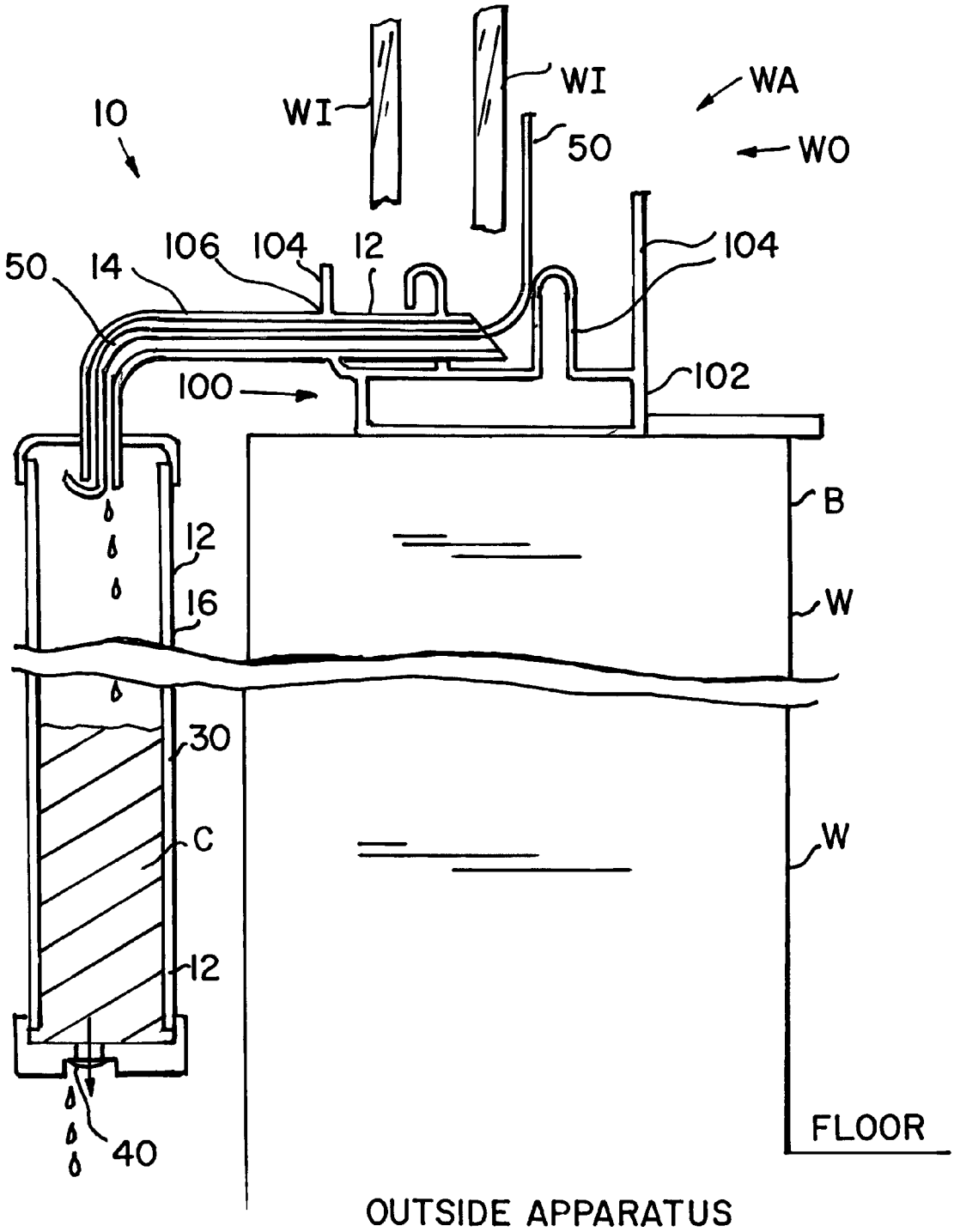
FIG. 1 is a cross-sectional side view of a portion of a building wall, the lower end of a window assembly opening, a window track mounted to the opening lower end, and the first embodiment of the present rain draining apparatus in which the standpipe is mounted outside the building.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

PREFERRED EMBODIMENTS

Figure 2:
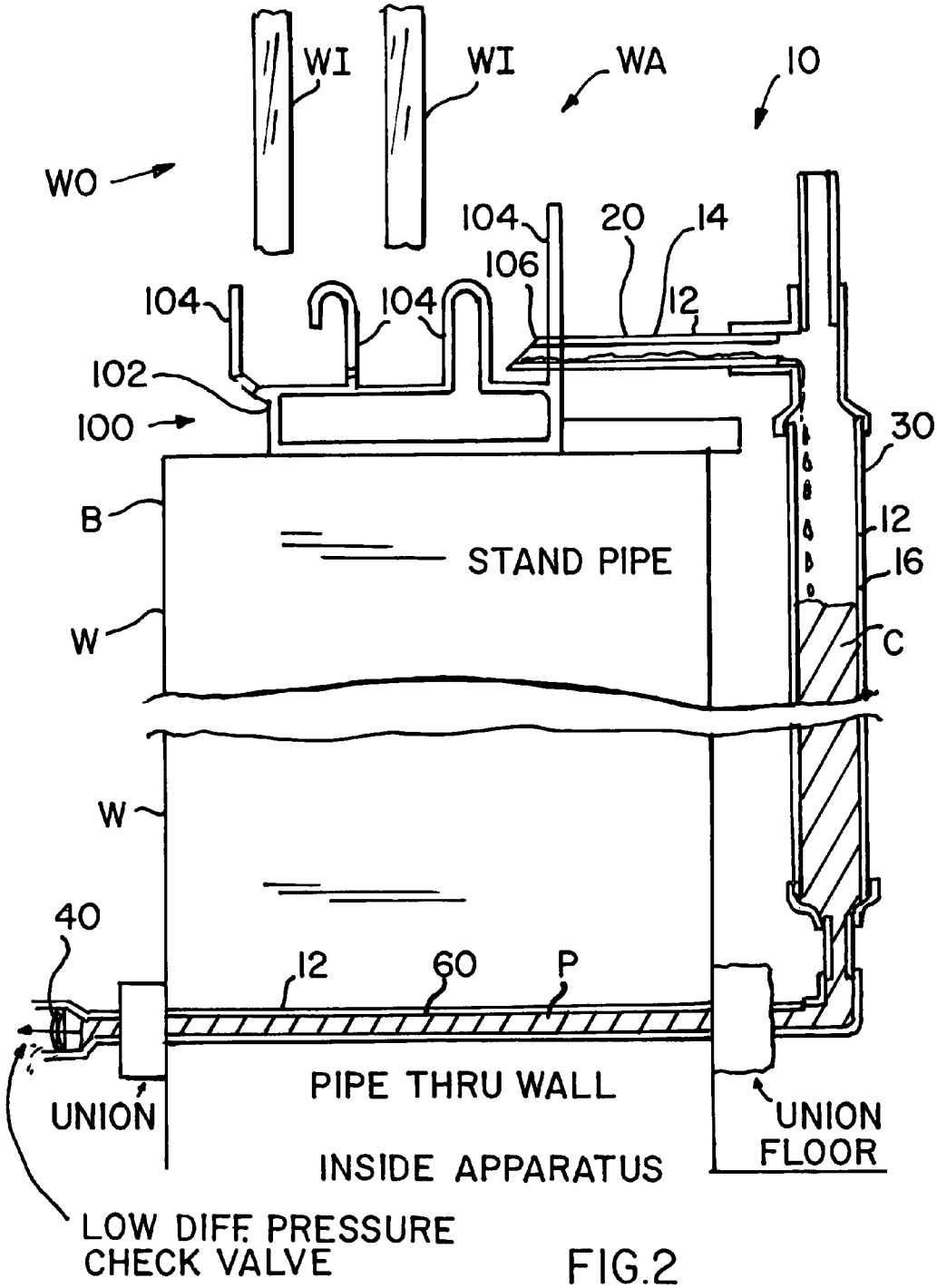
FIG. 2 is a cross-sectional side view as in FIG. 1 but showing the second embodiment of the present rain draining apparatus in which the standpipe is mounted inside the building.
Figure 3:
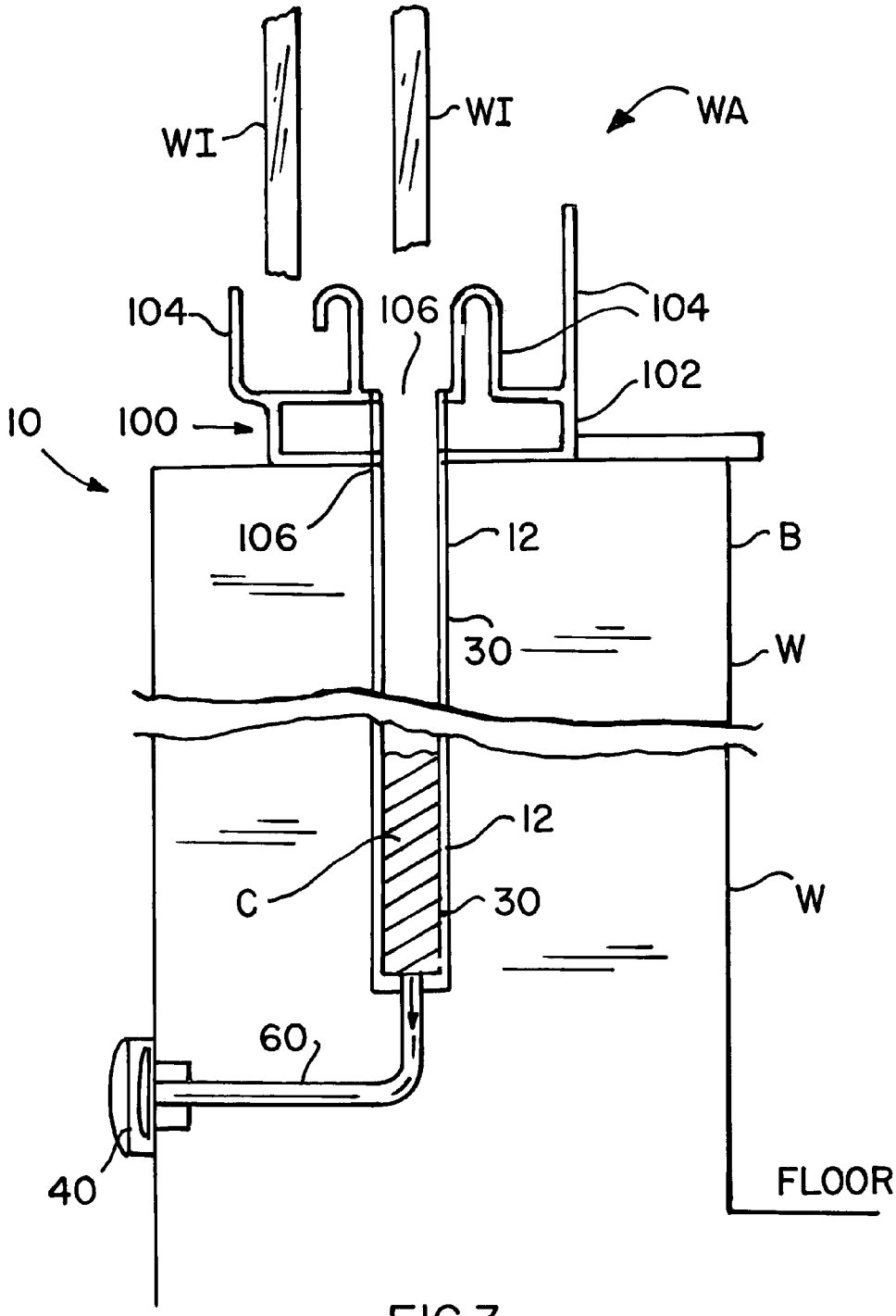
FIG. 3 is a cross-sectional side view as in FIG. 1 but showing the second embodiment of the present rain draining apparatus in which the standpipe is contained within the building wall.

Referring to FIGS. 1-3, a window track rain draining apparatus 10 is disclosed for use during high winds, such as from hurricanes which raise outside air pressure against a window assembly WA to a level greater than the air pressure within the building B. This pressure differential drives water collected in a window track 100 into the building B and prevents the collected water from draining outside the building B.

The present draining apparatus 10 provides a drain conduit 12 having a linking segment 14 extending from a point within the track 100 and inside the building B to an upright segment 16 containing a check valve 40 extending below the track 100 and to a point outside the building B, and provides a pressure equalizing vent structure 50 which equalizes air pressure throughout the drain conduit 12, permitting water in the track 100 to drain outside the building B. A sliding window assembly WA mounted within a window opening WO of a building wall W typically includes a track 100 configured as a channel 102 having window guides 104 including channel sides in the form of upright longitudinal flanges within the channel 102 and framed windows WI slidably retained within the window guides 102. The drain conduit linking segment 14 preferably takes the form of a drain tube 20 and the drain conduit upright segment 16 preferably takes the form of a standpipe 30, the drain tube 20 being fitted through at least one and typically two or more track ports 106 formed in the track guides 104 and leading into the standpipe 30. The check valve 40 is provided in the standpipe 30 lower end which permits water entering the standpipe 30 to accumulate as a column C and then to drain through the check valve 40 when the column C reaches a sufficient height and thus a sufficient weight to overcome the opposing force of the outside air pressure. The pressure equalizing vent structure 50 equalizes air pressure in the standpipe 30 above the column C of water with the air pressure inside the building B, and preferably takes the form of a pressure equalization tube 50 extending from inside the building B into the standpipe 30 upper end, and which preferably passes axially through the drain tube 20 into the standpipe 30. A column C height of only two inches can yield a force per unit area equal to outside air pressure of a 60 mile per hour wind. Yet standpipe 30 preferably has a height sufficient to retain and thus permit formation of a water column C much higher than two inches to overcome an outside air pressure much greater than that created by a 60 mile per hour wind.

The drain tube 20 preferably is connected to the standpipe 30 with a plumbing T. The check valve 40 preferably is a low differential check valve 40.

The standpipe 30 may be suspended either outside or inside the building B and along the building wall W, or within the building wall W, and below the window track 100, as shown respectively in FIGS. 1, 2 and 3, representing first, second and third embodiments of apparatus 10. Where the standpipe 30 is suspended inside the building B and along the building wall W, or within the building wall W, an extension tube 60 is connected to the standpipe 30, preferably with a union joint, and extends outside the building B through a horizontal passageway P in the building wall W. Where an extension tube 60 is provided, the check valve 40 preferably is mounted within the extension tube 60, rather than within the standpipe 30. The linking segment 14 in the form of drain tube 20 may be omitted for the embodiment shown in FIG. 3 in which the standpipe 30 is contained within the building wall W. The interior portion of this embodiment including the standpipe 30 may be removed easily and replaced easily as required.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A combined sliding window assembly and rain draining apparatus, comprising:

a building wall of a building having a window opening;

a sliding window assembly mounted within said window opening having a window track configured as a channel and windows slidably retained within said window track;

a rain draining apparatus comprising a drain conduit having a linking segment extending from and in fluid communication with a window track inside a building, and having an upright segment extending from and in fluid communication with said linking segment and extending below the entirety of said window opening and opening outside the building, said upright segment being in fluid communication with a check valve;

and a pressure equalizing vent structure for equalizing air pressure throughout said drain conduit extending from and opening within the building into said drain conduit upright segment;

such that water in said track flows through said linking segment and into said upright segment and accumulates as a column within said upright segment above said check valve and then drains through said check valve when the column reaches a sufficient height and thus a sufficient weight to overcome the opposing force of outside air pressure.

2. The rain draining apparatus of claim 1, wherein said drain conduit linking segment comprises a drain tube and wherein said drain conduit upright segment comprises a standpipe, said drain tube being fitted through at least one track port formed in said track and opening into said standpipe extending below said window track along the building wall;

and wherein said check valve is contained within the lower end of said standpipe wherein said standpipe is contained within the building wall and said standpipe extends below the window opening.

3. The rain draining apparatus of claim 1, wherein said pressure equalizing vent structure comprises a pressure equalization tube extending from inside the building and opening into said standpipe.

4. The rain draining apparatus of claim 3, wherein said pressure equalizing tube passes through said drain tube into said standpipe.

5. The rain draining apparatus of claim 1, wherein said drain conduit linking segment comprises a drain tube and wherein said drain conduit upright segment comprises a standpipe, said drain tube being fitted at least one through track port formed in said track and opening into said standpipe extending below said window track along the building wall;

and wherein said check valve is contained within the lower end of said standpipe.

6. The rain draining apparatus of claim 5, wherein said standpipe is suspended outside the building along the building wall.

7. The rain draining apparatus of claim 5, wherein said standpipe is contained within the building wall.

8. The rain draining apparatus of claim 5, wherein said standpipe is suspended inside the building along the building wall, additionally comprising an extension tube connected to and opening into said standpipe and extending outside the building through a passageway in the building wall.

9. The rain draining apparatus of claim 1, wherein said pressure equalizing vent structure comprises a pressure equalization tube extending from inside the building and opening into said standpipe.

10. The rain draining apparatus of claim 9, wherein said pressure equalizing tube passes through said drain tube into said standpipe.

11. A rain draining apparatus for a sliding window assembly of a building mounted within a window opening in a building wall having a track configured as a channel with window guides in the form of upright longitudinal flanges and framed windows slidably retained within the guides, the rain draining apparatus comprising:

a drain conduit having a linking segment extending from and in fluid communication with a window track inside a building, and having an upright segment extending from and in fluid communication with said linking segment and extending below said window track and opening outside the building, said upright segment being in fluid communication with a check valve;

and a pressure equalizing vent structure for equalizing air pressure throughout said drain conduit extending from and opening within the building into said drain conduit upright segment;

such that water in said track flows through said linking segment and into said upright segment and accumulates as a column within said upright segment above said check valve and then drains through said check valve when the column reaches a sufficient height and thus a sufficient weight to overcome the opposing force of outside air pressure;

wherein said drain conduit linking segment comprises a drain tube and wherein said drain conduit upright segment comprises a standpipe, said drain tube being fitted through at least one track port formed in said track and opening into said standpipe extending below said window track along the building wall;

wherein said check valve is contained within the lower end of said standpipe;

and wherein said standpipe is suspended outside the building along the building wall.

12. A rain draining apparatus for a sliding window assembly of a building mounted within a window opening in a building wall having a track configured as a channel with window guides in the form of upright longitudinal flanges and framed windows slidably retained within the guides, the rain draining apparatus comprising:

a drain conduit having a linking segment extending from and in fluid communication with a window track inside a building, and having an upright segment extending from and in fluid communication with said linking segment and extending below said window track and opening outside the building, said upright segment being in fluid communication with a check valve;

and a pressure equalizing vent structure for equalizing air pressure throughout said drain conduit extending from and opening within the building into said drain conduit upright segment;

such that water in said track flows through said linking segment and into said upright segment and accumulates as a column within said upright segment above said check valve and then drains through said check valve when the column reaches a sufficient height and thus a sufficient weight to overcome the opposing force of outside air pressure;

wherein said drain conduit linking segment comprises a drain tube and wherein said drain conduit upright segment comprises a standpipe, said drain tube being fitted through at least one track port formed in said track and opening into said standpipe extending below said window track along the building wall;

wherein said check valve is contained within the lower end of said standpipe;

and wherein said standpipe is suspended inside the building along the building wall, additionally comprising an extension tube connected to and opening into said standpipe and extending outside the building through a passageway in the building wall.

13. A combined sliding window assembly and rain draining apparatus, comprising:

a building wall of a building having a window opening;

a sliding window assembly mounted within said window opening having a window track configured as a channel and windows slidably retained within said window track;

a rain draining apparatus comprising a drain conduit having an upright segment extending from and in fluid communication with said window track inside the building and extending below the entirety of said window opening and opening outside the building, said upright segment being in fluid communication with a check valve, and an extension tube connected to and opening into said standpipe and extending outside the building through a passageway in the building wall; and a pressure equalizing vent structure for equalizing air pressure throughout said drain conduit extending from and opening within the building into said drain conduit upright segment; such that water in said track flows into said upright segment and accumulates as a column within said upright segment above said check valve and then drains through said check valve when the column reaches a sufficient height and thus a sufficient weight to overcome the opposing force of outside air pressure.

* * * * *